US010100769B2

(12) United States Patent
Maase et al.

(10) Patent No.: US 10,100,769 B2
(45) Date of Patent: Oct. 16, 2018

(54) METHOD AND COMPUTER PROGRAM FOR ACTUATING A FUEL INJECTOR

(71) Applicant: CONTINENTAL AUTOMOTIVE GMBH, Hannover (DE)

(72) Inventors: Jens Maase, Regensburg (DE); Volker Hertes, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 604 days.

(21) Appl. No.: 14/513,395

(22) Filed: Oct. 14, 2014

(65) Prior Publication Data

US 2015/0101575 A1 Apr. 16, 2015

(30) Foreign Application Priority Data

Oct. 11, 2013 (DE) ..... 10 2013 220 613

(51) Int. Cl.
*F02D 41/20* (2006.01)
*F02M 51/06* (2006.01)
*F02D 41/30* (2006.01)

(52) U.S. Cl.
CPC ..... *F02D 41/20* (2013.01); *F02M 51/061* (2013.01); *F02M 51/0625* (2013.01); *F02D 41/3005* (2013.01); *F02D 2041/2006* (2013.01)

(58) Field of Classification Search
CPC ..... H01F 2007/1822; F02M 51/0625; F02M 51/061; F02D 41/20; F02D 2041/2006; F02D 41/3005; F02D 2041/2003; F02D 2041/202; F02D 2041/2044
USPC ..... 123/490, 480, 485, 487, 488, 406.57; 701/101–105
See application file for complete search history.

(56) References Cited

U.S. PATENT DOCUMENTS 2,672,068 A * 3/1954 Hanert ..... G10H 5/02 331/106
4,082,066 A * 4/1978 Long ..... F02D 41/32 123/478
4,176,387 A * 11/1979 Harper ..... F02D 41/20 361/154

(Continued)

FOREIGN PATENT DOCUMENTS

CN 100523464 C 8/2009
DE 102010027989 A1 10/2011
JP H11351039 A * 12/1999 ..... F02D 41/20

*Primary Examiner* — Sizo Vilakazi
*Assistant Examiner* — Brian Kirby
(74) *Attorney, Agent, or Firm* — Laurence A. Greenberg; Werner H. Stemer; Ralph E. Locher

(57) ABSTRACT

A method actuates a fuel injector having a coil drive with a solenoid and a magnet armature. The magnet armature can be moved along a longitudinal axis by a magnetic field generated by the solenoid. In the method, an amplification voltage is applied to the solenoid at a predefined point in time to move the magnet armature from a closed position into an open position. The amplification voltage is made available by a voltage-regulated direct voltage transformer from a supply voltage. The direct voltage transformer has a storage capacitor for supporting the voltage made available at the output of the direct voltage transformer. The storage capacitor is charged to a pilot control voltage by the amplification voltage before the given point in time, with the result that the voltage present at the solenoid is higher than the amplification voltage at the predefined point in time.

9 Claims, 2 Drawing Sheets

(56) References Cited

U.S. PATENT DOCUMENTS 4,213,181 A * 7/1980 Carp ..... F02D 41/20 123/480
4,862,866 A * 9/1989 Calfus ..... F02D 41/3005 123/490
5,402,760 A * 4/1995 Takeuchi ..... F02D 41/20 123/300
5,711,280 A * 1/1998 Foerster ..... F02D 41/20 123/490
5,717,562 A * 2/1998 Antone ..... F02D 41/20 361/155
5,796,223 A * 8/1998 Ohtsuka ..... H01H 47/325 318/126
6,123,058 A * 9/2000 Endou ..... F02D 41/20 123/490
6,123,092 A * 9/2000 Torii ..... F02M 51/061 137/1
6,147,433 A * 11/2000 Reineke ..... F02D 41/2096 310/316.03
6,360,725 B1 * 3/2002 Scherrbacher ..... F02D 41/20 123/490
6,691,682 B2 * 2/2004 Rueger ..... F02D 41/2096 123/467
6,735,069 B2 * 5/2004 Ehara ..... B26D 5/08 361/159
7,107,976 B2 * 9/2006 Gu ..... F02D 41/20 123/480
7,316,220 B2 * 1/2008 Kikutani ..... F02D 41/20 123/467
7,415,964 B2 * 8/2008 Ban ..... F02D 41/20 123/299
7,823,860 B2 * 11/2010 Ueda ..... F02D 41/20 251/129.04
8,081,498 B2 * 12/2011 Mayuzumi ..... F02D 41/20 123/490
8,159,806 B2 * 4/2012 Cartier-Millon ..... H01F 7/081 335/234
2002/0166541 A1 * 11/2002 Yamakado ..... F02D 41/20 123/490
2003/0179003 A1 * 9/2003 Toda ..... G01D 3/028 324/679
2004/0196092 A1 * 10/2004 Tojo ..... F02D 41/20 327/534
2005/0047053 A1 * 3/2005 Meyer ..... F02D 41/20 361/139
2005/0180085 A1 * 8/2005 Santero ..... F02D 41/20 361/154
2007/0188967 A1 * 8/2007 Smith ..... H01F 7/1816 361/155
2007/0240675 A1 * 10/2007 Ban ..... F02D 41/20 123/299
2008/0083895 A1 * 4/2008 Ueda ..... F02D 41/20 251/129.15
2008/0184968 A1 * 8/2008 Matsuura ..... F02D 41/20 123/490
2008/0289608 A1 * 11/2008 Matsuura ..... F02D 41/20 123/490
2009/0217914 A1 * 9/2009 Casasso ..... F02D 41/20 123/490
2009/0243574 A1 * 10/2009 Mayuzumi ..... F02D 41/20 323/282
2010/0043757 A1 * 2/2010 Bolz ..... F02D 41/20 123/476
2010/0059023 A1 * 3/2010 Schmauss ..... H03K 17/08142 123/490
2010/0065022 A1 * 3/2010 Toner ..... F02D 41/2096 123/490
2010/0307456 A1 * 12/2010 Hengl-Betz ..... F02D 41/1402 123/478
2011/0309918 A1 * 12/2011 Ramsay ..... G08B 6/00 340/407.1
2012/0255282 A1 * 10/2012 Nagata ..... F01N 3/208 60/274
2012/0316755 A1 * 12/2012 Ibrahim ..... F02M 47/027 701/103
2012/0318883 A1 * 12/2012 Kusakabe ..... F02D 41/20 239/1
2014/0316679 A1 * 10/2014 Nishida ..... F02D 41/20 701/104

* cited by examiner

METHOD AND COMPUTER PROGRAM FOR ACTUATING A FUEL INJECTOR

CROSS-REFERENCE TO RELATED APPLICATION

This application claims the priority, under 35 U.S.C. § 119, of German application DE 10 2013 220 613.5, filed Oct. 11, 2013; the prior application is herewith incorporated by reference in its entirety.

BACKGROUND OF THE INVENTION

Field of the Invention

The invention relates to a method for actuating a fuel injector which contains a coil drive with a solenoid and a magnet armature, wherein the magnet armature can be moved along a longitudinal axis by a magnetic field which can be generated by the solenoid.

In such a fuel injector, a magnetic field, which moves the magnet armature of the coil drive along the longitudinal axis (displacement axis), is generated by suitable excitation of the solenoid. A needle of the fuel injector which, as a function of its position, closes an opening of the fuel injector or clears the opening for a certain time for the purpose of fuel injection, is connected to the magnet armature.

In what is referred to as an amplification phase, what is referred to as an amplification voltage is applied to the coil drive of the fuel injector in order to move the magnet armature as quickly as possible from its closed position into its open position. Then, a holding voltage, which is relatively low compared to the amplification voltage, can be applied to the solenoid of the coil drive of the fuel injector in what is referred to as a holding phase, in order to hold the magnet armature in its open position. The holding voltage is generally applied in the form of a multiplicity of holding pulses, with the result that a predefined holding current is set.

The voltage for driving the coil drive, referred to here as the amplification voltage, is generated with a direct voltage transformer (DC/DC transformer) from a supply voltage which is lower than the amplification voltage. The voltage which is made available by a battery in the on-board power system of a motor vehicle serves as the supply voltage. The direct voltage transformer contains a storage capacitor for supporting the voltage made available at the output of the direct voltage transformer if the consumer connected to the direct voltage transformer, i.e. the fuel injector, briefly draws a high current. The output of the direct voltage transformer is coupled to the fuel injector or the solenoid thereof.

In order to maintain the accuracy of the switching time of the fuel injector, precise voltage parameters are defined which have to be complied with during the activation of the fuel injector, which is to say during the injection of fuel into a combustion chamber of an internal combustion engine. A determining factor is a voltage drop, which is specified as the voltage drop during the time of extraction of energy from the storage capacitor. In order to keep the voltage drop small, storage capacitors with a high storage capacity and low equivalent series resistance (ESR) are preferably used. The ESR refers to the internal loss resistance of the storage capacitor. It is influenced by material, configuration and the conductivity of an electrolyte of the storage capacitor.

This results in the disadvantage of high costs since, on the one hand, storage capacitors with a high storage capacity have to be used and, on the other hand, only storage capacitors which have a low ESR can be used.

SUMMARY OF THE INVENTION

The object of the present invention is to specify a method and a computer program which give precise details on the maintenance of the accuracy of the switching time of a fuel injector.

A method for actuating a fuel injector which contains a coil drive with a solenoid and a magnet armature is proposed. The magnet armature can be moved along a longitudinal axis by a magnetic field which can be generated by the solenoid. In this method, an amplification voltage is applied to the solenoid at a predefined point in time in order to move the magnet armature from a closed position into an open position. The amplification voltage is made available by a voltage-regulated direct voltage transformer from a supply voltage which is lower in comparison. The direct voltage transformer contains a storage capacitor for supporting the voltage which is made available at the output of the direct voltage transformer. The storage capacitor of the direct voltage transformer is charged to a pilot control voltage by the amplification voltage before the given point in time, with the result that the voltage present at the solenoid is higher than the amplification voltage at the predefined point in time.

The invention is based on the idea that at the predefined point in time, which marks the start of movement of the magnet armature and therefore the start of the injection process, the amplification voltage which is to be kept constant by the direct voltage transformer in order to move the magnet armature from its closed position to its open position drops. The voltage drop, which results from the discharging of the storage capacitor owing to the brief, high drawing of current by the fuel injector, is detected by the direct voltage transformer. The direct voltage transformer subsequently charges the storage capacitor in order to restore the desired value of the amplification voltage. The delayed regulation of the amplification voltage by the direct voltage transformer is therefore partially responsible for the undesired voltage drop.

In order to reduce the voltage drop, pilot control takes place during which the storage capacitor is already charged beyond the desired level of the amplification voltage to what is referred to as a pilot control voltage before the predefined point in time which marks the start of movement of the magnet armature and therefore the start of the injection process. In other words, this means that the absolute value of the pilot control voltage is higher than the absolute value of the amplification voltage. This results in the voltage present at the solenoid or the fuel injector being higher at the predefined point in time than the amplification voltage which is necessary per se.

The amplification voltage represents the voltage which is specified by the manufacturer of the fuel injector and which has to be used or should be used for the injection process. The amplification voltage is therefore a setpoint voltage for the operation of the fuel injector.

This means that before the injection process, the energy of the storage capacitor is increased. A consequence of this procedure is that the level of the voltage drop is reduced in absolute terms across the fuel injector or the solenoid. As a result, the direct voltage transformer can be equipped with a storage capacitor which is relatively small in comparison, which provides cost advantages. Alternatively it is possible to use a storage capacitor which entails lower fabrication costs.

The charging of the storage capacitor can begin at a point in time determined by calculation, with the result that the storage capacitor has the pilot control voltage precisely at the predefined point in time which marks the start of movement of the magnet armature and therefore the start of the injection process.

The charging of the storage capacitor can alternatively begin at a point in time determined by calculation, with the result that the storage capacitor has the pilot control voltage before the predefined point in time which marks the start of movement of the magnet armature and therefore the start of the injection process. The level of the pilot control voltage is then held in the period of time between the pilot control voltage being reached and the predefined point in time.

The duration between the start of the charging of the storage capacitor and the predefined point in time can be selected to be constant for every injection process, i.e. every actuation of the fuel injector. The calculation of the duration can be carried out by a model. The length of the duration is generally dependent on the configuration of the control unit or the fuel injector to be actuated.

After the determination of the abovementioned period of time according to one of the two specified alternatives, the point in time of the charging of the storage capacitor can then occur before the predefined point in time, since the predefined point in time is basically known to a control unit for carrying out the method.

The charging of the storage capacitor can be carried out by the direct voltage transformer. A storage capacitor which has a low ESR is expediently used. For this purpose, electrolyte capacitors with a wet electrolyte, with a hybrid electrolyte or with a dry electrolyte can be used for example.

The pilot control voltage is obtained from the amplification voltage and a tolerance supplement for the amplification voltage. The tolerance supplement thus corresponds to the degree of gain by which the voltage drop can be reduced compared to a conventional actuation.

The point in time of the start of charging of the storage capacitor can be adapted as a function of a temperature, determined by measurement, in the surroundings of the fuel injector. This means that the duration of the charging of the storage capacitor is shortened or lengthened as a function of the temperature.

In particular, there is provision that the duration of the charging of the storage capacitor is shortened as the temperature drops. This means that the start of charging occurs relatively late compared to actuation during which the temperature is not taken into account.

In a further refinement, the point in time of the start of charging of the storage capacitor can be adapted as a function of ageing of the fuel injector. Therefore the duration of the charging of the storage capacitor is shortened or lengthened as a function of a state of ageing which is determined, for example, by computer, stored in a memory or determined by measurement.

In particular there is provision that the duration of the charging of the storage capacitor is shortened as the ageing increases. Therefore the start of charging occurs relatively late compared to an actuation during which the ageing is not taken into account.

The invention also provides a computer program product for actuating a fuel injector for an internal combustion engine of a motor vehicle, which computer program product can be loaded directly into the internal memory of a digital computer, in particular of a control unit for actuating the fuel injector, and contains software code sections with which the steps of one of the claims explained above are executed when the product runs on the computer.

Other features which are considered as characteristic for the invention are set forth in the appended claims.

Although the invention is illustrated and described herein as embodied in a method and a computer program for actuating a fuel injector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
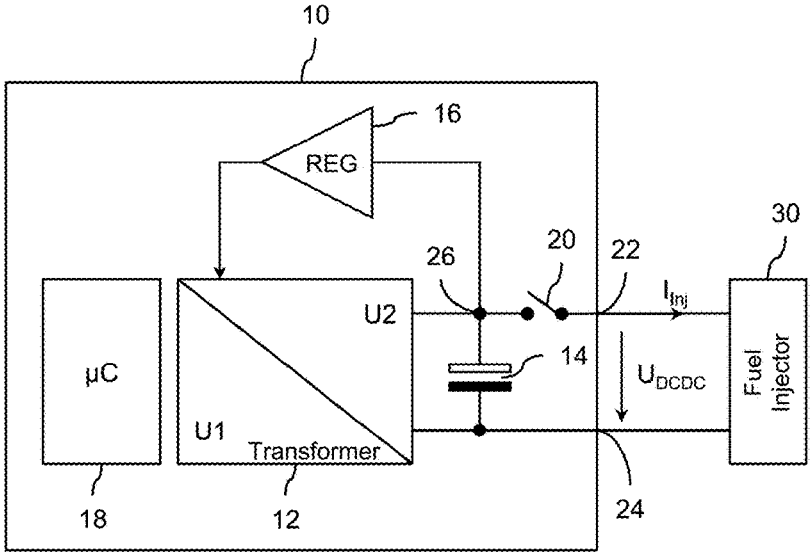
Fig. 1 Prior Art
FIG. 1 is a schematic illustration of a device for actuating a fuel injector for an internal combustion engine of a motor vehicle according to the prior art.

In the figures, identical elements are provided with identical reference symbols. Referring now to the figures of the drawings in detail and first, particularly to FIG. 1 thereof, there is shown a conventional control unit 10 for actuating a fuel injector 30 for an internal combustion engine of a motor vehicle. The fuel injector 30 which is not illustrated here in more detail is a conventional fuel injector which has, in a known fashion, a coil drive with a solenoid. Suitable excitation of the solenoid causes a magnetic field to be generated which moves a magnet armature of a coil drive along a longitudinal axis (displacement axis of the magnet armature). Connected to the magnet armature is a needle of the fuel injector which, as a function of its position, closes an opening of the fuel injector or clears it for a certain time for the purpose of fuel injection.

In what is referred to as an amplification phase, an amplification voltage is applied to the coil drive of the fuel injector in order to move the magnet armature as quickly as possible from its closed position into its open position. Then, a holding voltage which is relatively low compared to the amplification voltage can be applied to the solenoid of the coil drive of the fuel injector in a holding phase, in order to hold the magnet armature in its open position. The holding voltage is generally applied in the form of a multiplicity of holding pulses, with the result that a predefined holding current is set. This differentiation is not taken into account for the present invention.

The amplification voltage UDCDC, which constitutes a setpoint voltage, is made available by a control unit 10 at output terminals 22, 24. The control unit 10 contains for this purpose a direct voltage transformer 12, a storage capacitor 14, a voltage regulator 16, a computer unit (microcontroller) 18 and a switching element 20. The direct voltage transformer 12 generates an output voltage U2 from an input voltage U1. The input voltage U1, for example 12 V, is made available by a non-illustrated energy store of the motor vehicle. The output voltage U2 corresponds to the voltage UDCDC of the direct voltage transformer 12 at its output terminals and the output terminals 22, 24 of the control unit 10. The voltage UDCDC represents essentially the above-mentioned amplification voltage whose level depends on a specification of the fuel injector 30. The amplification voltage is 65 V (=setpoint voltage) in this exemplary embodiment, as is illustrated also in the diagram in FIG. 2.

The direct voltage transformer 12 is connected on the output side to the two terminals of the storage capacitor 14 and the fuel injector 30. For a person skilled in the art it is clear that the terminals of the direct voltage transformer 12 are connected here to the coil drive, i.e. the solenoid. The switching element 20 is connected between the already mentioned output terminal 22 and one of the output terminals of the direct voltage transformer 12. If a voltage is to be applied to the fuel injector 30 for the purpose of opening, the switching element 20 is closed. Otherwise, it is opened. The control of the switching position of the switching element 20 is carried out by the computer unit 18.

The object of the storage capacitor 14 is to support the amplifier voltage UDCDC made available at the output of the direct voltage transformer 12, when the fuel injector 30 briefly draws a high current during the injection process for the purpose of opening. The energy which is necessary to open the fuel injector 30 is extracted from the storage capacitor 14, as a result of which the voltage between the output terminals 22, 24 and therefore at node 26 drops. This is clearly apparent in FIG. 2.

Figure 2:
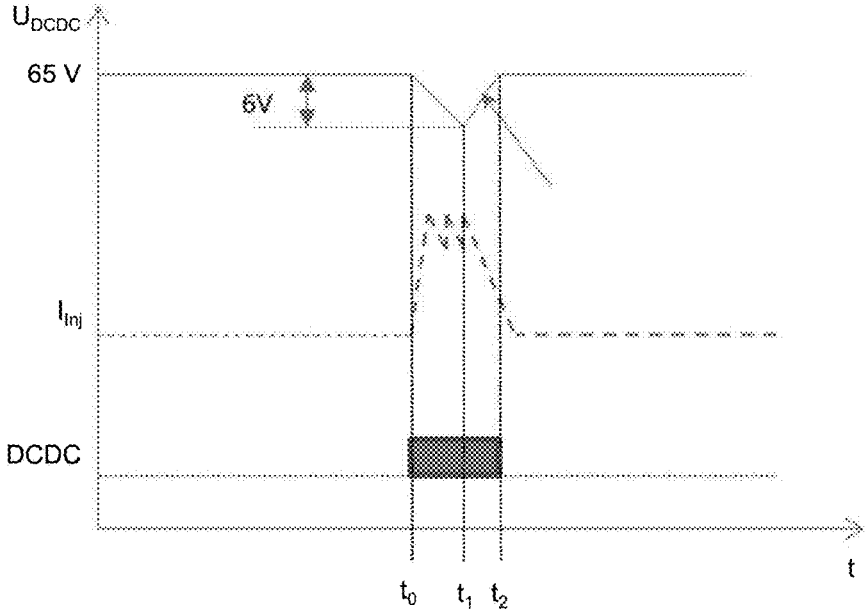
Fig. 2 Prior Art
FIG. 2 is a graph showing a current profile and a voltage profile during a conventional actuation of the fuel injector from FIG. 1.

FIG. 2 illustrates the profile of the amplification voltage UDCDC and the profile of a current $I_{inj}$ flowing into the fuel injector 30 or the solenoid thereof, together with information DCDC as to the points in time at which the voltage regulator 16 of the direct voltage transformer 12 is active. At the point in time t0, the opening process of the fuel injector 30 starts, i.e. the solenoid is energized. At the point in time t0, the specified amplification voltage UDCDC at a level of 65 V is present at the output 22, 24 of the control unit 10 and therefore at the fuel injector 30. Owing to the brief and high current extraction by the fuel injector 30 subsequent to the point in time t0, the amplification voltage UDCDC drops up to a point in time t1 by, for example, 6 V to 59 V. The level of this voltage drop of the amplification voltage UDCDC is dependent on the size of the storage capacity of the storage capacitor 14 and the internal resistance (ESR) thereof.

The voltage drop at the output of the direct voltage transformer 12 is detected by the voltage regulator 16, which is connected on the input side to the node 26 between the output of the direct voltage transformer 12 and the storage capacitor 14. An output of the voltage regulator 16 is connected to the direct voltage transformer 12, as a result of which the latter brings about recharging of the storage capacitor 14 in order to regulate the amplification voltage UDCDC again to 65 V. At the point in time t2, the voltage UDCDC at the output of the direct voltage transformer 12 has reached the setpoint value of 65 V again.

As is readily apparent from FIG. 2, the current $I_{inj}$ rises briefly after the point in time t0, remains between t0 and t2 at a level which permits the opening of the fuel injector 30, and drops again approximately at the point in time t1 to zero, as a result of which the fuel injector 30 begins to close again. It is also apparent that the direct voltage transformer (see the information DCDC) is active between t0 and t2.

Figure 3:
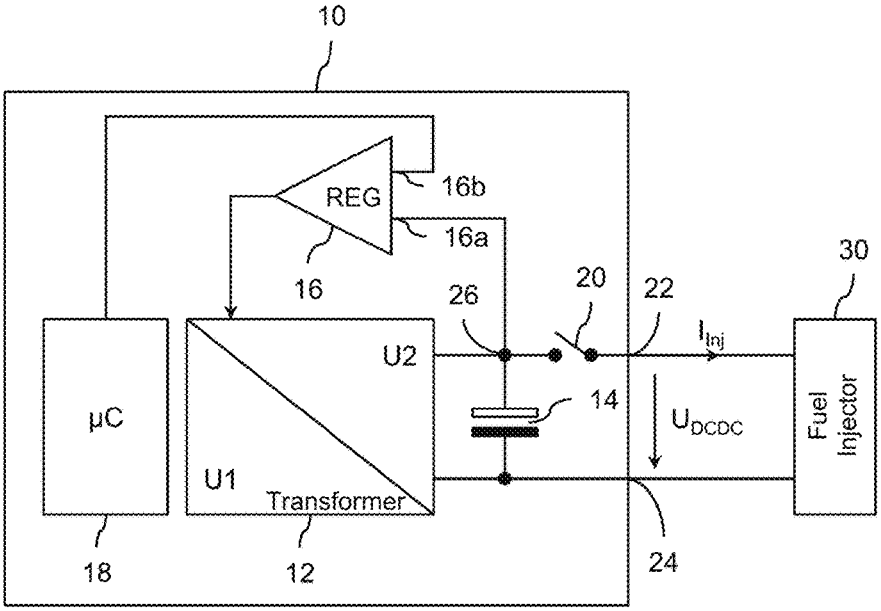
FIG. 3 is a schematic illustration of a device according to the invention for actuating the fuel injector for the internal combustion engine of the motor vehicle.

FIG. 3 shows the control unit 10 according to the invention for actuating a fuel injector 30 for an internal combustion engine of a motor vehicle. The design of the control unit 10 according to the invention differs from the design described in FIG. 1 only in that the voltage regulator 16 has two inputs 16*a* and 16*b*. The first input 16*a* is, as in FIG. 1, connected to the node 26 between the output of the direct voltage transformer 12 and the storage capacitor 14. At the first input 16*a*, the voltage at the output of the direct voltage transformer 12 or of the control unit 10 is detected in order to bring about recharging of the storage capacitor 14 in the case of a dropping voltage UDCDC, in order to regulate the amplification voltage UDCDC again to the setpoint value, i.e. in this example 65 V.

In addition, the second input 16*b* is connected to the computer unit 18 which permits the behavior of the direct voltage transformer 12 to be influenced in the sense of pilot control.

Figure 4:
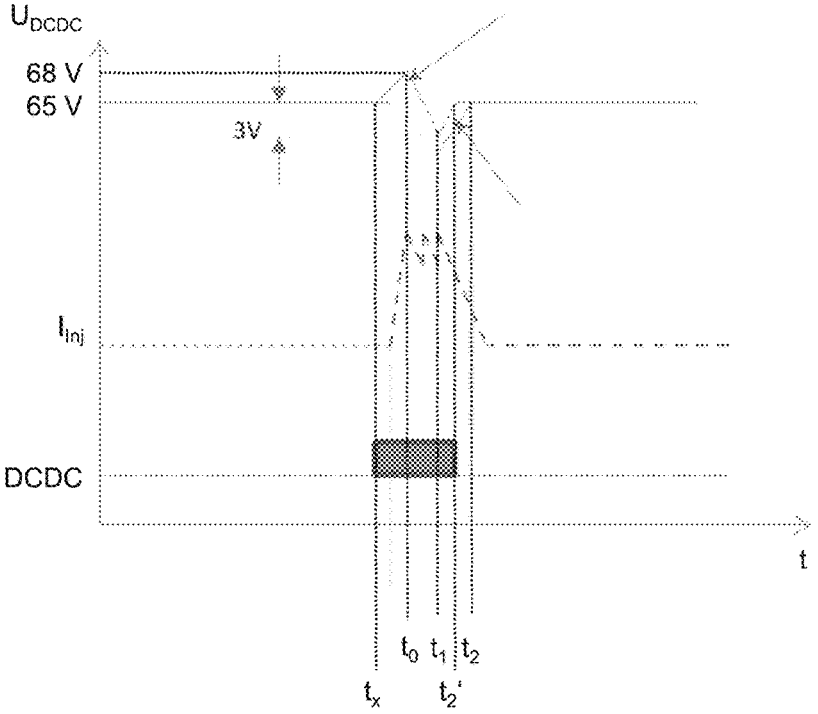
FIG. 4 is a graph of a current profile and a voltage profile during an inventive actuation of the fuel injector from FIG. 3.

In order to reduce the voltage drop which is 6 V between t0 and t1 with the conventional configuration, before the point in time t0, i.e. at the point in time tx, the storage capacitor 14 is charged by the direct voltage transformer 12 by the rated amplification voltage of 65 V, with the result that the storage capacitor 14 has a voltage of, for example, 68 V at the point in time t0 (see FIG. 4). This voltage is referred to as a pilot control voltage.

At the point in time t0, the opening process of the fuel injector 30 starts, i.e. the solenoid is energized and $I_{inj}$ rises at the point in time t0 and stays, by analogy with FIG. 2, at a high level until the closing of the fuel injector occurs. At the point in time t0, the pilot control voltage is at a level of 68 V at the output 22, 24 of the control unit 10 and therefore at the fuel injector 30 owing to the previously executed charging process. Owing to the brief and high current extraction by the fuel injector 30 subsequent to the point in time t0, the voltage drops again up to the point in time t1 by, for example, 6 V to 62 V. Compared to the specified amplification voltage of 65 V, the voltage drop is therefore only 3 V.

The voltage drop at the output of the direct voltage transformer 12 is detected at the point in time t1 by the voltage regulator 16, since the latter is connected by its input 16*a* to the node 26 between the output of the direct voltage transformer 12 and the storage capacitor 14. A signal is generated at the output of the voltage regulator 16, as a result of which signal the voltage regulator 16 brings about recharging of the storage capacitor 14 in order to regulate the amplification voltage UDCDC again to 65 V. At the point in time t2', the voltage UDCDC at the output of the direct voltage transformer 12 has reached the setpoint value of 65 V again. Since only the voltage difference of 3 V now has to be compensated, the point in time t2' is reached before the point in time t2, which describes the conventional end of recharging. The profile of the conventional actuation is additionally illustrated in FIG. 4 for the purpose of comparison.

The period of time between the point in time tx at which the charging of the storage capacitor 14 begins and the point in time t0 at which the fuel injector 30 opens, can be determined by a calculation. The period of time is dependent on the configuration of the control unit 10 and the actual behavior of the fuel injector 30. Once the period of time has been determined, it can be used constantly by the computer unit 18 for every opening process of the fuel injector 30.

In one refinement it is possible for the period of time to be adapted as a function of the temperature in the surroundings of the fuel injector 30. Here, the duration of the charging of the storage capacitor 14 can be shortened or lengthened as a function of the temperature. In particular, there is provision for the duration of the charging of the storage capacitor to be shortened as the temperature drops. This means that the start of charging occurs relatively late compared to an actuation during which the temperature is not taken into account.

In a further refinement, the point in time of the start of charging of the storage capacitor 14 can be adapted as a function of ageing of the fuel injector 30. Therefore the duration of the charging of the storage capacitor 14 is shortened or lengthened as a function of a state of ageing which is determined, for example, by computer and stored in the computer unit 18 or determined by measurement. In particular there is provision for the duration of the charging of the storage capacitor 14 to be shortened as the ageing increases. Therefore the start of charging occurs relatively late compared to an actuation during which the ageing is not taken into account.

If the pilot control voltage which is aimed at in the scope of the pilot control is reached before the point in time t0, the voltage of the storage capacitor 14 is thus kept constant at the level of the pilot control voltage up to the point in time t0.

The proposed method is based on knowledge-based, premature switching on of the direct voltage transformer 12 in order to synchronize the start of the charging or of recharging of the storage capacitor 14 with the start of the injection. An advantage of this procedure is that the storage capacitor 14 can be made relatively small compared to a conventional actuation, since the storage capacitor 14 experiences only a relatively small voltage drop in comparison. Alternatively, it is possible to use components in the control unit which entail lower fabrication costs.

The invention claimed is:

1. A method for actuating a fuel injector having a coil drive with a solenoid and a magnet armature, wherein the magnet armature can be moved along a longitudinal axis by a magnetic field being generated by the solenoid, which comprises the steps of:

applying an amplification voltage to the solenoid at a predefined point in time to move the magnet armature from a closed position into an open position, wherein the amplification voltage being made available by a voltage-regulated direct voltage transformer from a supply voltage which is lower in comparison than the amplification voltage, the voltage-regulated direct voltage transformer containing a storage capacitor for supporting the amplification voltage being made available at an output of the voltage-regulated direct voltage transformer;

providing a voltage at the solenoid being higher than the amplification voltage at the predefined point in time by performing a step of charging the storage capacitor of the voltage-regulated direct voltage transformer to a pilot control voltage by means of the amplification voltage before the predefined point in time; and adapting a point in time of a start of the charging of the storage capacitor in dependence on an ageing of the fuel injector.

2. The method according to claim 1, wherein the charging of the storage capacitor begins at a point in time determined by calculation, with a result that the storage capacitor has the pilot control voltage precisely at the predefined point in time.

3. The method according to claim 1, wherein the charging of the storage capacitor begins at a point in time determined by calculation, with a result that the storage capacitor has the pilot control voltage before the predefined point in time.

4. The method according to claim 1, which further comprises carrying out the charging of the storage capacitor by means of the voltage- regulated direct voltage transformer.

5. The method according to claim 1, wherein the pilot control voltage is obtained from the amplification voltage and a tolerance supplement for the amplification voltage.

6. The method according to claim 1, wherein a point in time of a start of the charging of the storage capacitor is adapted in dependence on a temperature, determined by measurement, in surroundings of the fuel injector.

7. The method according to claim 6, which further comprises shortening a duration of the charging of the storage capacitor as the temperature drops.

8. The method according to claim 1, which further comprises shortening a duration of the charging of the storage capacitor as the ageing increases.

9. A computer program product for actuating a fuel injector for an internal combustion engine of a motor vehicle, the computer program product being loaded directly into a non-transitory internal memory of a digital computer and containing software code sections for performing a method for actuating the fuel injector having a coil drive with a solenoid and a magnet armature, wherein the magnet armature can be moved along a longitudinal axis by a magnetic field being generated by the solenoid, which method comprises the steps of:

applying an amplification voltage to the solenoid at a predefined point in time to move the magnet armature from a closed position into an open position, wherein the amplification voltage being made available by a voltage-regulated direct voltage transformer from a supply voltage which is lower in comparison than the amplification voltage, the voltage-regulated direct voltage transformer containing a storage capacitor for supporting the amplification voltage being made available at an output of the voltage-regulated direct voltage transformer;

providing a voltage at the solenoid being higher than the amplification voltage at the predefined point in time by performing a step of charging the storage capacitor of the voltage-regulated direct voltage transformer to a pilot control voltage by means of the amplification voltage before the predefined point in time; and adapting a point in time of a start of the charging of the storage capacitor in dependence on an ageing of the fuel injector.

* * * * *